US009388607B2

(12) United States Patent
Travers et al.

(10) Patent No.: US 9,388,607 B2
(45) Date of Patent: Jul. 12, 2016

(54) POLICE CAR RESTRAINT SYSTEM

(71) Applicants: Mark A. Rusco, Jacksonville, FL (US); Kim A. Travers, Neptune Beach, FL (US)

(72) Inventors: Kim A. Travers, Neptune Beach, FL (US); Mark A. Rusco, Jacksonville, FL (US); John R. Stevens, Jacksonville, FL (US)

( * ) Notice: Subject to any disclaimer, the term of this patent is extended or adjusted under 35 U.S.C. 154(b) by 0 days.

(21) Appl. No.: 14/204,743

(22) Filed: Mar. 11, 2014

(65) Prior Publication Data

US 2015/0121973 A1 May 7, 2015

Related U.S. Application Data

(60) Provisional application No. 61/776,212, filed on Mar. 11, 2013.

(51) Int. Cl.
*E05B 75/00* (2006.01)

(52) U.S. Cl.
CPC ..... *E05B 75/00* (2013.01); *Y10T 70/404* (2015.04)

(58) Field of Classification Search
CPC .. A61B 5/6831; Y10T 24/21; Y10T 70/5009; Y10T 24/318; Y10T 24/2532; Y10T 24/40; Y10T 24/50; Y10T 70/409; Y10T 24/142; Y10T 24/2192; Y10T 24/3427; Y10T 24/44; Y10T 24/47; Y10T 70/404
USPC ..... 70/14, 16, 18, 19, 30, 49; 128/846, 869, 128/878, 879, 882
See application file for complete search history.

(56) References Cited

U.S. PATENT DOCUMENTS

| | | | | | |
|---|---|---|---|---|---|
| 539,650 | A * | 5/1895 | Searle | 70/16 | |
| 583,796 | A * | 6/1897 | Ferrell | 70/16 | |
| 1,823,697 | A * | 9/1931 | Nenstiehl | 70/16 | |
| 4,949,679 | A * | 8/1990 | Wolfer | 70/16 | |
| 5,345,947 | A * | 9/1994 | Fisher | 128/878 | |
| 5,469,813 | A * | 11/1995 | Peden | 119/770 | |
| 5,542,433 | A * | 8/1996 | Saupe | 128/869 | |
| 5,551,447 | A * | 9/1996 | Hoffman et al. | 128/869 | |
| 6,360,747 | B1 * | 3/2002 | Velarde et al. | 128/869 | |
| 6,637,077 | B2 * | 10/2003 | Doty | B60P 3/079 | 24/298 |
| 6,913,020 | B2 * | 7/2005 | Chapman | 128/870 | |
| 7,000,438 | B1 * | 2/2006 | Cooper et al. | 70/16 | |

(Continued)

*Primary Examiner* — Suzanne Barrett
(74) *Attorney, Agent, or Firm* — Allen Dyer Doppelt Milbrath & Gilchrist

(57) ABSTRACT

A prisoner restraint system for securing a prisoner in a police car, the system having a locking attachment member securing the system to the child seat anchor located above and behind the rear seat, a first strap member having an upper end connected to the locking attachment member and a lower end to which a prisoner locking member is attached, the prisoner locking member adapted to be locked onto either a pair of handcuffs securing the prisoner's arms or the prisoner's arm itself, a second strap member of relatively short length having an upper end connected to the locking attachment member and a lower end to which a quick-release secured latch assembly is attached, a third strap member of relatively long length having an upper end connected to the locking attachment member and a lower free end, a tongue assembly mounted onto the third strap member in a manner allowing the tongue assembly to be repositioned along the third strap member to shorten or lengthen the restraining portion of the third strap member, the tongue assembly being received by the quick-release secured latch assembly in a manner whereby a release key is required to release the tongue assembly.

12 Claims, 1 Drawing Sheet

(56) References Cited

U.S. PATENT DOCUMENTS 7,140,077 B1 * 11/2006 Parsons ..... E05B 75/00 24/16 PB
7,581,416 B1 * 9/2009 Lenertz ..... 70/16
2010/0319412 A1 * 12/2010 Espinosa ..... 70/16
2015/0315823 A1 11/2015 Stevens

* cited by examiner

POLICE CAR RESTRAINT SYSTEM

CROSS-REFERENCE TO RELATED APPLICATIONS

This application claims benefit of U.S. provisional application Ser. No. 61/776,212, filed Mar. 11, 2013, the contents of which are incorporated by reference herein, and which has at least one common inventor with the present application.

BACKGROUND OF THE INVENTION

1. Field of the Invention

This invention relates generally to the field of restraint systems and more particularly relates to restraint systems for prisoners being transported in law enforcement vehicles, such as in the rear seat of a police car.

2. Description of Related Art

The transport of individuals such as arrestees or prisoners in the back seat of police cars is a common occurrence, and in many instances the individuals must be restrained for the safety of the officers and/or for their own safety. Often the individual is restrained using a pair of handcuffs, the arms of the individual being handcuffed behind the individual's back. In some instances though, a violent or non-cooperative individual requires further restraint, and it is known to provide a secondary restraint system to further restrain the individual such that movement from one location on the seat is restricted.

It is an object of this invention to provide such a secondary restraint system whereby the individual is secured to one location on the seat, the restraint system being capable of attachment to the standard child seat anchor provided in all vehicles (such as the vehicle's top tether anchor points, part of what is commonly known as the LATCH, or Lower Anchors and Tethers for Children, system), and whereby the restraint system attaches directly to the handcuffs or the individual's arm, and also whereby the restraint system restricts movement of the individual's torso.

BRIEF SUMMARY OF THE INVENTION

The invention is in general a restraint system for securing and restricting movement of an individual placed into a law enforcement vehicle, such as in the back seat of a police car. The restraint system comprises a locking attachment member, a first strap or belt member having an upper end connected to the locking attachment member and a lower end to which a prisoner locking member is attached, a second strap or belt member of relatively short length having an upper end connected to the locking attachment member and a lower end to which a first keyed assembly member is attached, a third strap or belt member of relatively long length having an upper end connected to the locking attachment member and a lower free end, a second keyed assembly member being mounted onto the third strap or belt in a manner allowing the second keyed assembly member to be repositioned along the third strap or belt to shorten or lengthen the restraining portion of the third strap or belt. The first keyed assembly member and the second keyed assembly member are configured to interlock in a secure, releasable manner. The locking attachment mechanism is adapted to secure the system to any available element of the vehicle's structure, preferably, the child seat anchor located above and behind the rear seat in police cars. The prisoner locking member is preferably adapted to be locked onto either a pair of handcuffs securing the prisoner's arms or the prisoner's arm itself, The first and second keyed assembly members can be a keyed latch assembly and a tongue assembly whereby the keyed latch assembly is adapted to receive the tongue assembly such that the tongue assembly cannot be released from the keyed latch assembly without a key or particular mechanical object, whereby the prisoner cannot release the tongue assembly using only hands or fingers. In one embodiment, a standard seat belt latch assembly encased within a slotted buckle cover may be utilized, wherein an elongated metal object or the like must be inserted through a slot to release the tongue assembly.

In an embodiment wherein the locking attachment member is connected to the child seat anchor, the first, second and third strap members will hang down the front of the seatback. To secure the prisoner, the prisoner locking member connected to the first strap member, such as for example one of the locking assemblies of a standard pair of handcuffs, is locked to the handcuffs or onto the prisoner's arm. The third strap member is then positioned beneath one arm, brought across the torso and then up behind the other arm such that the first and second keyed assembly member can be brought together into mating engagement, for example, the tongue assembly can be inserted into the keyed latch assembly. The free end of the third strap is then pulled to tighten the third strap around the prisoner's torso. To release the prisoner, the tongue assembly is released from the keyed latch assembly and the prisoner locking member is removed from the prisoner or the handcuffs.

DETAILED DESCRIPTION

Figure 1:
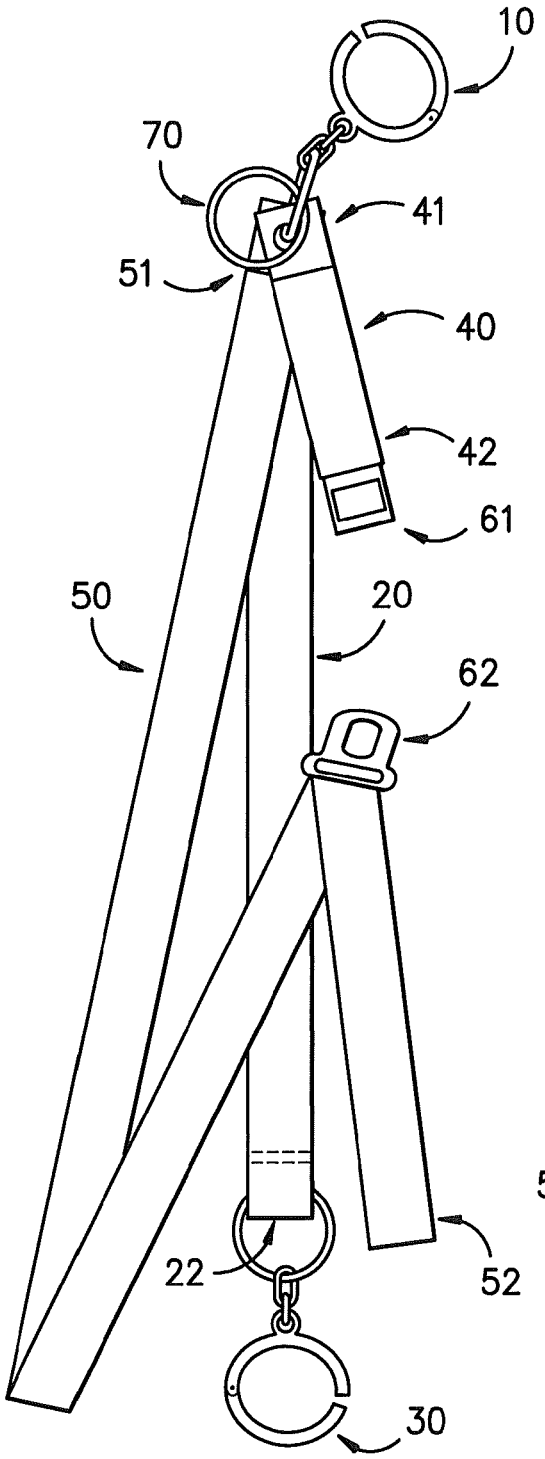
FIG. 1 is a frontal view of an embodiment of the invention.

In the following description, relative terms such as "upper," "lower," "top," and "bottom" are with reference to the orientation shown generally in FIGS. 1 and 2. Further, such relative terms are understood to refer to the intended use of the disclosed restraint system in the environment of a police car, whereby terms such as "upper" are in reference to a direction towards or position closer to the roof of the vehicle, and terms such as "lower" are in reference to a direction towards or position closer to the floor of the vehicle.

The invention, an embodiment of which is illustrated in the drawings, is described in general as a restraint system for securing and restricting movement of an individual or prisoner placed into a law enforcement vehicle, for example in the back seat of a police car, the restraint system comprising a locking attachment member 10 adapted to secure the system to the vehicle structure, e.g., by attachment to the child safety seat anchor located above and behind the rear seat in police cars, whereby the restrained prisoner is not able to remove the restraint system from the child seat anchor. For example, the locking attachment member 10 may comprise a single handcuff that requires a handcuff key to be unlocked. As another example, the locking attachment member 10 may comprise a secure clasp, such as a standard baby seat latch assembly encased within a buckle cover to prevent operation of the latch release button by finger, the buckle cover having a small slot located in front of the release button, wherein an elongated metal object or the like, such as the extended portion of an automobile key, must be inserted through the slot to depress the release button in order to release the latch assembly.

Figure 2:
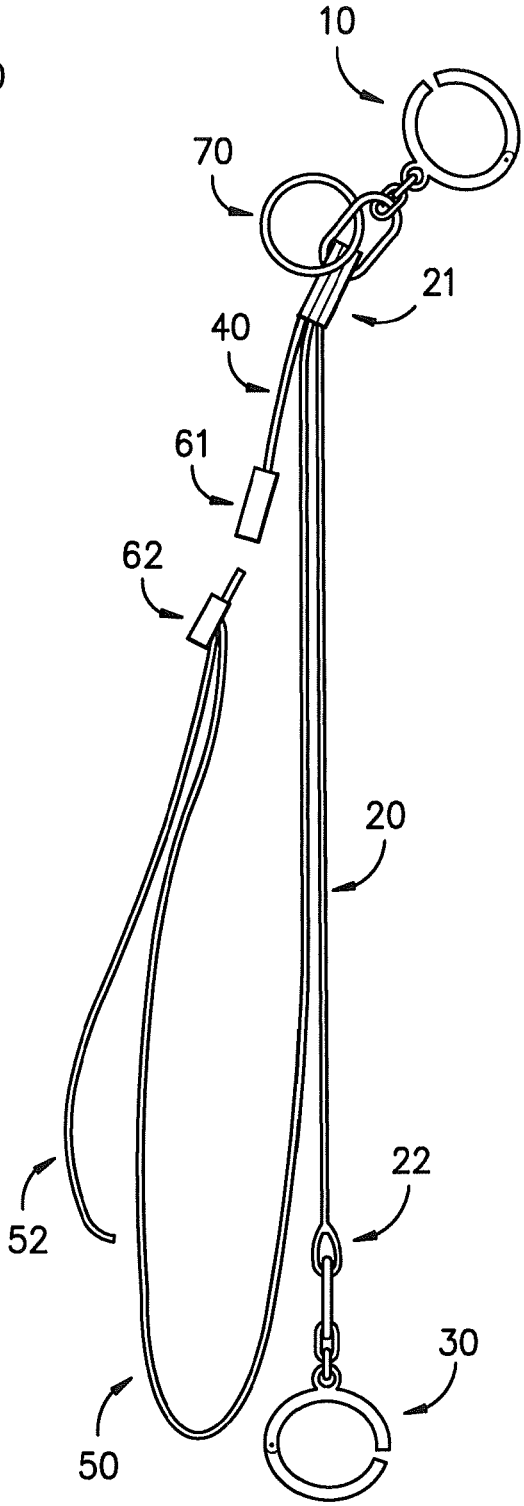
FIG. 2 is a side view of the embodiment of FIG. 1.

In the embodiment illustrated in FIG. 1 and FIG. 2, the restraint system further comprises a first strap, belt, cable, chain or similar elongate flexible member 20, to be referred to collectively herein as a strap, having an upper end 21 connected to the locking attachment member and a lower end 22 to which a prisoner locking member 30 is attached, the prisoner locking member preferably adapted to be locked onto either the chain of a pair of handcuffs securing the prisoner's arms or the prisoner's arm itself, whereby the prisoner cannot release or open the prisoner locking member 30. For example, the prisoner locking member 30 may comprise a single handcuff that requires a handcuff key to be unlocked.

With continuing reference to the embodiment illustrated in FIG. 1 and FIG. 2, the restraint system further comprises a second strap, belt, cable, chain or similar elongate flexible member 40, to be referred to collectively herein as a strap, of relatively short length and having an upper end 41 connected to the locking attachment member 10 and a lower end 42 to which a first keyed assembly member, which is illustrated as a quick-release secured latch assembly 61, is attached, such as for example a buckle assembly of the type commonly used in seat belts in combination with a security mechanism.

Also in the embodiment illustrated in FIG. 1 and FIG. 2, the restraint system further comprises a third strap, belt, cable, chain or similar flexible member 50, to be referred to collectively herein as a strap, of relatively long length having an upper end 51 connected to the locking attachment member 10 and a lower free end 52, a second keyed assembly member, which is illustrated as a tongue assembly 62, being mounted onto the third strap in a manner allowing the tongue assembly 62 to be repositioned at different positions along the third strap 50 to shorten or lengthen the restraining portion of the third strap or belt 50, which restraining portion is defined as the portion of third strap or belt 50 between the locking attachment member 10 and the tongue assembly 62. The tongue assembly 62 is received by the quick-release secured latch assembly 61 in secure releasable manner. For example, the strap 50 may comprise a seat belt material and the tongue assembly 62 may comprise a seat belt tongue assembly.

The quick-release secured latch assembly 61 is a mechanism whereby the tongue assembly 62 cannot be released from the quick-release secured latch assembly 61 without a release key or particular mechanical object, such that the prisoner cannot release the tongue assembly 62 using only hands or fingers. While a standard key-lock mechanism may be utilized, it is preferred that the quick-release secured latch assembly can be opened with a quick and direct insertion of the release key not requiring precise alignment, turning, etc. In one embodiment, a standard seat belt latch assembly encased within a buckle cover to prevent operation of the seat belt latch release button by finger may be utilized, the buckle cover having a small slot located in front of the release button, wherein an elongated metal object or the like, such as the extended portion of an automobile key, must be inserted through the slot to depress the release button in order to release the tongue assembly 62.

A leg restraint ring member 70 may be connected adjacent to the locking attachment member 10 such that the free end of a leg strap, belt, cable chain or like leg restraining mechanism may be secured thereto during transport of the prisoner.

With the locking attachment member 10 connected to the child seat anchor, the first, second and third strap members, 20, 40, and 50, respectively, will hang down the front of the seatback. To secure the prisoner, the prisoner locking member connected to the first strap member 20 is locked to the handcuffs or onto the prisoner's atm. The third strap member 50 is then positioned beneath one arm, brought across the prisoner's torso and then up behind the other arm such that the tongue assembly 62 can be inserted into the quick-release secured latch assembly 61 connected to the second strap 40. The free end 52 of the third strap 50 is then pulled to tighten the third strap 50 around the prisoner's torso, in the same manner that a traditional seat belt is tightened. To remove the prisoner from the police car, the release key is inserted through the buckle cover to release the tongue assembly 62 from the quick-release secured latch assembly 61 and the prisoner locking member 30 is removed from the prisoner or the handcuffs.

While preferred embodiments and example configurations have been shown and described, it is to be understood that various further modifications and additional configurations will be apparent to those skilled in the art. All such modifications and configurations are contemplated as being within the scope of the present invention. The specific embodiments and configurations disclosed are illustrative of the preferred and best modes for practicing the invention as defined by the appended claims, and should not be interpreted as limitations on the scope of the invention as defined by the appended claims. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A restraint system for securing and restricting movement of an individual in the back seat of a police car, said restraint system comprising:

a locking attachment member adapted to secure the restraint system to a vehicle attachment point, a first elongate flexible member having an upper end and a lower end, said first elongate flexible member pivotally connected to the locking attachment member at said upper end, a prisoner locking member attached to said lower end of said first elongate flexible member said prisoner locking member operable to open, receive a pair of handcuffs while in its open state, then enclose and lock onto said pair of handcuffs, a second elongate flexible member having an upper end and a lower end, said second elongate flexible member pivotally connected to the locking attachment member at said upper end, a first keyed assembly member attached to said lower end of said second elongate flexible member, a third elongate flexible member having an upper end and a free lower end, said third elongate flexible member pivotally connected to the locking attachment member at said upper end, each of said first elongate flexible member, said second elongate flexible member, and said third elongate flexible member being distinct from every other elongate flexible member and only connected to one another indirectly via said connection to the locking attachment member, said third elongate flexible member having a restraining portion which is bounded by said locking attachment member and a second keyed assembly member, said second keyed assembly member mounted onto said third elongate flexible member and configured to be repositionable along the third elongate flexible member, whereby said restraining portion of said third elongate flexible member can be adjusted, and said first keyed assembly member adapted to receive said second keyed assembly member in a secure, releasable manner.

2. The restraint system of claim 1, wherein said first keyed assembly member comprises a quick-release secured latch assembly, and said second keyed assembly member comprises a tongue assembly.

3. The restraint system of claim 1, wherein said first elongate flexible member comprises a strap, said second elongate flexible member comprises a strap, and said third elongate flexible member comprises a strap.

4. The restraint system of claim 3 wherein said first, second, and third straps comprise a seat belt material.

5. A restraint system for securing and restricting movement of an individual in the back seat of a police car, said restraint system comprising:

a locking attachment clasp adapted to secure the restraint system to a vehicle attachment point, a first elongate flexible member having an upper end and a lower end, said first elongate flexible member pivotally connected to the locking attachment clasp at said upper end, a prisoner locking clasp attached to said lower end of said first elongate flexible member, said prisoner locking clasp operable to open, receive a pair of handcuffs while in its open state, then enclose and lock onto said pair of handcuffs, a second elongate flexible member having an upper end and a lower end, said second elongate flexible member pivotally connected to the locking attachment clasp at said upper end, a first keyed assembly member attached to said lower end of said second elongate flexible member, a third elongate flexible member having an upper end and a free lower end, said third elongate flexible member pivotally connected to the locking attachment clasp at said upper end, said third elongate flexible member having a restraining portion which is bounded by said locking attachment clasp and a second keyed assembly member, each of said first elongate flexible member, said second elongate flexible member, and said third elongate flexible member being distinct from every other elongate flexible member and only connected to one another indirectly via said connection to the locking attachment clasp, said second keyed assembly member mounted onto said third elongate flexible member and configured to be repositionable along the third elongate flexible member, whereby said restraining portion of said third elongate flexible member can be adjusted, and said first keyed assembly member receives said second keyed assembly member in a secure, releasable manner.

6. The restraint system of claim 5, wherein said first keyed assembly member comprises a quick-release secured latch assembly, and said second keyed assembly member comprises a tongue assembly.

7. The restraint system of claim 5, wherein said first elongate flexible member comprises a strap, said second elongate flexible member comprises a strap, and said third elongate flexible member comprises a strap.

8. The restraint system of claim 7 wherein said first, second, and third straps comprise a seat belt material.

9. A restraint system for securing and restricting movement of an individual in the back seat of a police car, said restraint system comprising:

a locking attachment clasp adapted to secure the restraint system to a vehicle attachment point, a first elongate flexible member having an upper end and a lower end, said first elongate flexible member pivotally connected to the locking attachment clasp at said upper end, a handcuff attached to said lower end of said first elongate flexible member, a second elongate flexible member having an upper end and a lower end, said second elongate flexible member pivotally connected to the locking attachment clasp at said upper end, a first keyed assembly member attached to said lower end of said second elongate flexible member, a third elongate flexible member having an upper end and a free lower end, said third elongate flexible member pivotally connected to the locking attachment clasp at said upper end, said third elongate flexible member having a restraining portion which is bounded by said locking attachment clasp and a second keyed assembly member, each of said first elongate flexible member, said second elongate flexible member, and said third elongate flexible member being distinct from every other elongate flexible member and only connected to one another indirectly via said connection to the locking attachment clasp, said second keyed assembly member mounted onto said third elongate flexible member and configured to be repositionable along the third elongate flexible member, whereby said restraining portion of said third elongate flexible member can be adjusted, and said first keyed assembly member receives said second keyed assembly member in a secure, releasable manner.

10. The restraint system of claim 9, wherein said first keyed assembly member comprises a quick-release secured latch assembly, and said second keyed assembly member comprises a tongue assembly.

11. The restraint system of claim 9, wherein said first elongate flexible member comprises a strap, said second elongate flexible member comprises a strap, and said third elongate flexible member comprises a strap.

12. The restraint system of claim 11 wherein said first, second, and third straps comprise a seat belt material.

* * * * *